US011682376B1

(12) United States Patent
Lashkari et al.

(10) Patent No.: US 11,682,376 B1
(45) Date of Patent: Jun. 20, 2023

(54) AMBIENT-AWARE BACKGROUND NOISE REDUCTION FOR HEARING AUGMENTATION

(71) Applicant: Cirrus Logic International Semiconductor Ltd., Edinburgh (GB)

(72) Inventors: Khosrow Lashkari, Austin, TX (US); Doug Olsen, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 17/713,302

(22) Filed: Apr. 5, 2022

(51) Int. Cl.
*G10K 11/178* (2006.01)

(52) U.S. Cl.
CPC .. *G10K 11/17853* (2018.01); *G10K 11/17837* (2018.01)

(58) Field of Classification Search
None
See application file for complete search history.

(56) References Cited

U.S. PATENT DOCUMENTS 7,885,810 B1 * 2/2011 Wang ..... G10L 21/0208 704/226
10,297,272 B2 * 5/2019 Elshamy ..... G10L 21/0364
2021/0058713 A1 * 2/2021 Jensen ..... H04R 25/453

OTHER PUBLICATIONS

Cohen, Israel et al. "Noise Estimation by Minima Controlled Recursive Averaging for Robust Speech Enhancement." IEEE Signal Processing Letters, vol. 9, No. 1, Jan. 2002. pp. 12-15.
Ephraim, Yariv et al. "Speech Enhancement Using a Minimum Mean-Square Error Short-Time Spectral Amplitude Estimator." IEEE Transactions on Acoustics, Speech, and Signal Processing, vol. ASSP-32, No. 6. Dec. 1984. pp. 1109-1121.

* cited by examiner

*Primary Examiner* — Kenny H Truong
(74) *Attorney, Agent, or Firm* — E. Alan Davis; Huffman Law Group, PC

(57) ABSTRACT

An ambient-aware audio system reduces stationary noise and maintains dynamic environmental sound in a received input audio signal. The system includes a signal-to-noise ratio (SNR) estimator that estimates an a priori SNR and an a posteriori SNR, a gain function that uses the estimated SNRs as inputs to compute coefficients of a frequency domain noise reduction filter that uses the computed coefficients to filter a frame of the input audio signal to generate an output audio signal. The SNR estimator, gain function, and filter are configured to iterate over a plurality of frames of the input audio signal. The SNRs are estimated using the input audio signal and the output audio signal associated with one or more of the plurality of frames. The gain function is derived to minimize an expected value of differences between spectral amplitudes of the output audio signal and the input audio signal.

21 Claims, 7 Drawing Sheets

AMBIENT-AWARE BACKGROUND NOISE REDUCTION FOR HEARING AUGMENTATION

BACKGROUND

Ambient noise can affect the intelligibility of speech or quality of other playback such as music produced by audio devices. For this reason, various audio devices perform ambient noise reduction. For example, portable audio devices, such as wireless telephones (e.g., mobile/cellular telephones, cordless telephones) and other consumer audio devices (e.g., mp3 players) in widespread use and headsets that connect to them, such as earbuds and headphones, may perform ambient noise reduction. Common examples of ambient noise sources include fans, appliances, engines, road noise inside an automobile and crowd babble. The ambient noise produced by such sources is commonly referred to as stationary noise because it persists for a relatively long time without changing its characteristics. Stationary noise is typically unwanted and may be annoying and negatively affect playback because it may enter the ear canal—even propagating through a headset in an attenuated manner—and negatively affect the playback intelligibility or quality.

Audio devices that perform ambient noise reduction typically include a single microphone, commonly referred to as a reference microphone, that receives ambient sounds that may include stationary or nonstationary noise. Noise reduction systems are different from noise cancellation systems. Noise cancellation typically uses two or more microphones, one microphone picks up the noisy audio and the other microphone picks up mostly the noise. Noise reduction systems significantly reduce the ambient audio picked up by the reference microphone. However, it has been recognized that significantly reducing the ambient audio may be undesirable in some situations. For example, the ambient audio may include important information that the user of the audio device needs to hear, e.g., for their own safety or the safety of someone else. For example, the ambient audio may include the sound of a car approaching the user as the user attempts to cross the street. For another example, the ambient audio may include the sound of a baby crying to which the user needs to attend. For another example, the ambient audio may include the sound of a horn being honked by another car that the user needs to avoid. For another example, the ambient audio may include the ambient speech of someone needing to get the attention of the user. Therefore, some audio devices include an ambient-aware mode during which noise reduction is disabled so as not to remove the ambient sounds the user needs to hear.

SUMMARY

In one embodiment, the present disclosure provides an ambient-aware audio system that reduces stationary noise and maintains dynamic environmental sound in a received input audio signal. The system includes a signal-to-noise ratio (SNR) estimator that estimates an a priori SNR and an a posteriori SNR, a gain function that uses the estimated a priori SNR and the a posteriori SNR as inputs to compute coefficients of a frequency domain noise reduction filter, and the frequency domain noise reduction filter that uses the computed coefficients to filter a frame of the input audio signal to generate an output audio signal. The SNR estimator, gain function, and filter are configured to iterate over a plurality of frames of the input audio signal. The a posteriori SNR and a priori SNR are estimated using the input audio signal and the output audio signal associated with one or more of the plurality of frames. The gain function is derived to minimize an expected value of differences between spectral amplitudes of the output audio signal and the input audio signal.

In another embodiment, the present disclosure provides a method, in an ambient-aware audio system that receives an input audio signal that includes stationary noise and dynamic environmental sound, of reducing the stationary noise and maintaining the dynamic environmental sound. The method includes (a) providing an a priori signal-to-noise ratio (SNR) and an a posteriori SNR as inputs to a gain function to output coefficients of a frequency domain noise reduction filter, (b) filtering a frame of the input audio signal using the frequency domain noise reduction filter to generate an output audio signal, and (c) iterating steps (a) and (b) over a plurality of frames of the input audio signal. The a posteriori SNR and a priori SNR are estimated using the input audio signal and the output audio signal associated with one or more of the plurality of frames. The gain function is derived to minimize an expected value of differences between spectral amplitudes of the output audio signal and the input audio signal.

In yet another embodiment, the present disclosure provides a non-transitory computer-readable medium having instructions stored thereon that are capable of causing or configuring an ambient-aware audio system that receives an input audio signal that includes stationary noise and dynamic environmental sound and reduces the stationary noise and maintains the dynamic environmental sound by performing operations. The operations include (a) providing an a priori signal-to-noise ratio (SNR) and an a posteriori SNR as inputs to a gain function to output coefficients of a frequency domain noise reduction filter, (b) filtering a frame of the input audio signal using the frequency domain noise reduction filter to generate an output audio signal, and (c) iterating steps (a) and (b) over a plurality of frames of the input audio signal. The a posteriori SNR and a priori SNR are estimated using the input audio signal and the output audio signal associated with one or more of the plurality of frames. The gain function is derived to minimize an expected value of differences between spectral amplitudes of the output audio signal and the input audio signal.

DETAILED DESCRIPTION

Embodiments of an ambient-aware hearing augmentation noise reduction system are described that dynamically adjusts the amount of reduction of the ambient audio, rather than merely turning noise reduction on or off in a binary fashion. The embodiments sense dynamic environmental sounds present in the ambient audio and adjust the gain of a frequency domain noise reduction filter that substantially filters unwanted stationary noise out of the ambient audio while substantially leaving wanted dynamic environmental sound. Examples of dynamic environmental sound may include the sounds produced by an approaching car, a crying baby, a honking horn, announcements, alarms, conversational speech, etc. More specifically, the frequency domain noise reduction filter coefficients are adapted based on both estimated a priori signal-to-noise ratio (SNR) and estimated a posteriori SNR. Advantageously, the embodiments described may significantly reduce stationary noise with minimal impact on speech or other desired dynamic environmental sound that may be present in the ambient audio.

Figure 1:
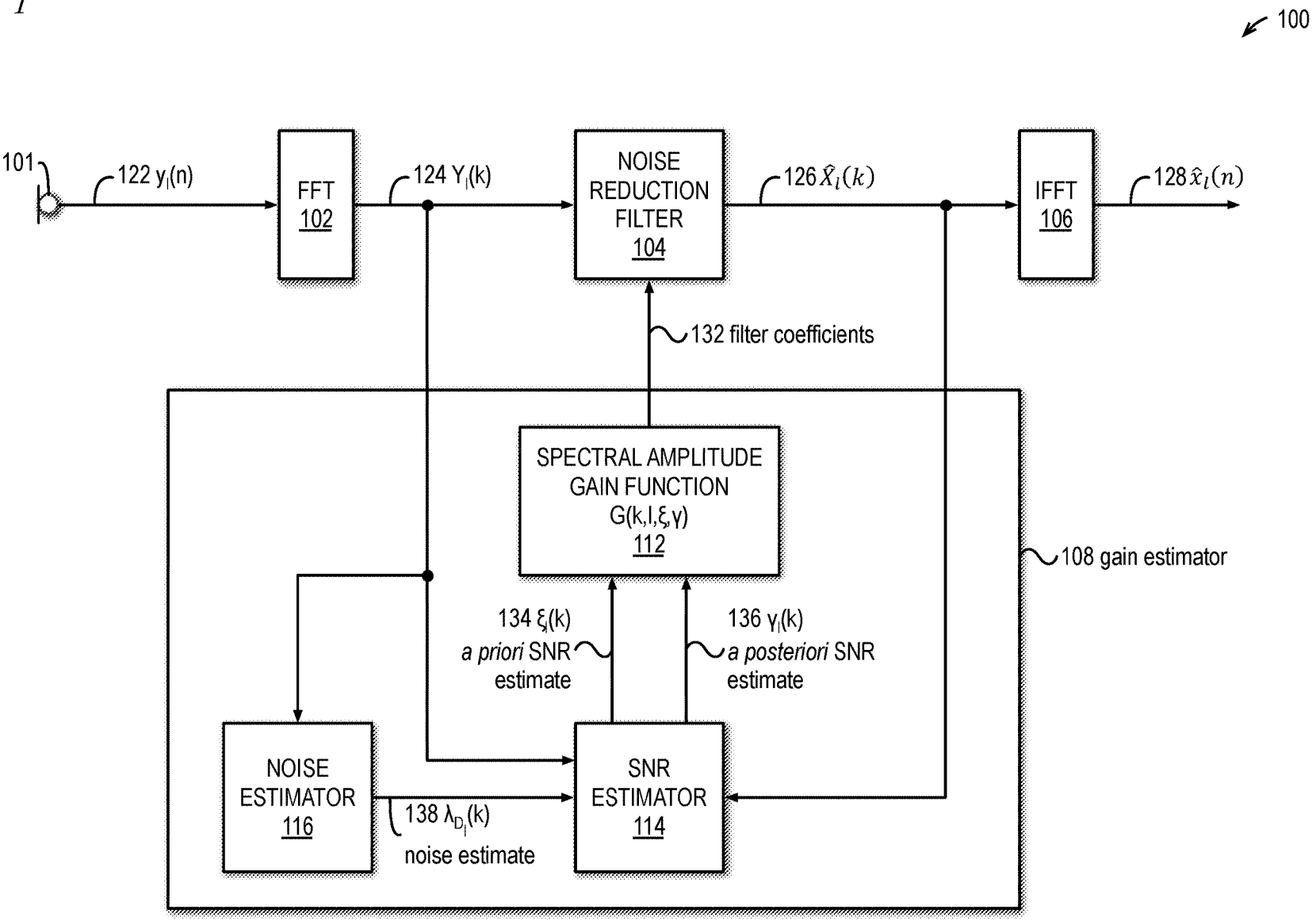
FIG. 1 is an example ambient-aware noise reduction system in accordance with embodiments of the present disclosure.

FIG. 1 is an example ambient-aware noise reduction system 100 in accordance with embodiments of the present disclosure. The system 100 includes a microphone 101, a fast Fourier transform (FFT) block 102, a noise reduction filter 104, an inverse FFT (IFFT) block 106, and a gain estimator 108. The gain estimator 108 includes a noise estimator 116, a SNR estimator 114 and a gain function block 112.

The microphone 101 receives a noisy time-domain ambient audio signal $y_l(n)$ 122, where l denotes an audio frame index, and n denotes a time index. The noisy time-domain ambient audio signal 122 may include both unwanted stationary noise and wanted dynamic environmental sound. The microphone 101 may be a reference microphone that may reside on the outer portion of a headset (e.g., outside the portion of the headset that enters the ear canal or outside the portion of the headset that covers the ear) such that the ambient sounds received by the reference microphone are not attenuated by the headset material itself. Alternatively, the reference microphone may reside on a volume control box or neck band of the headset.

The FFT block 102 performs a fast Fourier transform on the noisy time-domain ambient audio signal 122 to produce a noisy frequency-domain ambient audio signal $Y_l(k)$ 124, where k denotes an audio frequency bin index. The noisy frequency-domain ambient audio signal 124 is provided as the input signal to the noise reduction filter 104 and is also provided to the noise estimator 116 and to the SNR estimator 114. The noisy frequency-domain ambient audio signal 124 is also referred to as the input audio signal 124. The noise reduction filter 104 filters the input audio signal 124 to output a noise-reduced ambient audio signal $\hat{X}_l(k)$ 126. The noise-reduced ambient audio signal 126 is also referred to as the output audio signal 126. The inverse FFT block 106 performs an inverse fast Fourier transform on the noise-reduced ambient audio signal 126 to produce a time-domain noise-reduced ambient audio signal $\hat{x}_l(n)$ 128. The output audio signal 126 is also provided to the SNR estimator 114.

The output audio signal 126, i.e., the output of the noise reduction filter 104, is the frequency-domain estimate of the ambient audio signal 124 minus the stationary noise component of the ambient audio signal 124, which may be referred to as the ideal frequency domain signal, or the desired frequency domain signal. Similarly, the time-domain noise-reduced ambient audio signal 128 is an estimate of the difference between the ambient audio signal 122 minus the stationary noise component of the ambient audio signal 122. The difference may be referred to as the ideal time domain signal or as the desired time domain signal.

The noise estimator 116 generates a noise estimate $\lambda_{D_l}(k)$ 138 of the noise in the input audio signal 124, as described in more detail below, and provides the noise estimate 138 to the SNR estimator 114. The SNR estimator 114 uses the noise estimate 138 and the input audio signal 124 and the output audio signal 126 to estimate the a priori SNR $\xi_l(k)$ 134 and to estimate the a posteriori SNR $\gamma_l(k)$ 136 associated with the audio frame l, as described in more detail below. The SNR estimator 114 provides the estimated a priori SNR 134 and the a posteriori SNR 136 to the gain function 112. The gain function 112 uses the estimated a priori SNR 134 and the a posteriori SNR 136 as inputs to compute the filter coefficients 132. The gain function 112 then outputs the filter coefficients 132 to the noise reduction filter 104 for each audio frame. The noise reduction filter 104 filters the input audio signal 124 by multiplying the input audio signal 124 by the filter coefficients 132. That is, for each frequency bin, the noise reduction filter 104 applies a gain to the component of the input audio signal 124 associated with that frequency bin. The gain is the value of the filter coefficient for the frequency bin. For frequency bins in which the gain/coefficient value is less than one, the level of the frequency bin component of the output audio signal 126 is reduced relative to the level of the input audio signal 124, which may accomplish noise reduction in the output audio signal 126; in contrast, when the gain/coefficient value is greater than one, the level of the frequency bin component of the output audio signal 126 is increased relative to the level of the input audio signal 124, which may accomplish a boost in the output audio signal 126 when needed, e.g., when dynamic environmental sound is significantly present, as described in more detail below. In one embodiment, the operations performed by the FFT block 102, noise reduction filter 104, IFFT block 106, SNR estimator 114, and/or gain function 112 may be performed by a digital signal processor (DSP) or other programmable processor.

The noise reduction filter 104 is a linear, time-varying frequency domain filter. The frequency domain filter coefficients 132 of the noise reduction filter 104 change from one audio frame to the next. The form of the noise reduction filter 104 depends upon the distortion measure used, which is determined by the gain function 112. In the embodiments described herein, the gain function 112 is a spectral amplitude (SA) distortion measure gain function given in equation (1) as, $$G(k, l, \xi_{l|l'}(k), \gamma_l(k)) = \frac{\sqrt{\pi \nu_l(k)}}{2\gamma_l(k)}\left[(1+\nu_l(k))I_0\left(\frac{\nu_l(k)}{2}\right)+\nu_l(k)I_1\left(\frac{\nu_l(k)}{2}\right)\right]\exp\left(-\frac{\nu_l(k)}{2}\right) \quad (1)$$

where $v_l(k)$ is given in equation (2) as, $$v_l(k) = \frac{\xi_{ll'}(k)}{1 + \xi_{ll'}(k)} \gamma_l(k) \tag{2}$$

where $\xi_{ll'}(k)$ is the estimated a priori SNR at frame l for frequency bin index k using the input and output audio signal 126 up to frame l', where $\gamma_l(k)$ is the estimated a posteriori SNR at frame l and bin k and where $I_0$ and $I_1$ are modified Bessel functions of the zeroth and first order, respectively. That is, for each frequency bin k, the frequency bin component of the a priori SNR 134 and the frequency bin component of the a posteriori SNR 136 are provided as inputs to the SA gain function 112 of equation (1) to compute the frequency bin coefficient 132 of the noise reduction filter 104. That is, the frequency bin coefficient 132 is the output value of the SA gain function 112. The output value of the SA gain function may also be referred to as the gain since it is multiplied by the corresponding frequency bin component of the input audio signal 124 to produce the corresponding frequency bin component of the output audio signal 126 during operation of the noise reduction filter 104. The SA distortion measure gain function of equation (1) is derived to minimize the expected value of differences between spectral amplitudes of the output audio signal 126 and the input audio signal 124. The SA distortion measure gain function was derived in the paper, "Speech Enhancement Using a Minimum Mean-Square Error Short-Time Spectral Amplitude Estimator," by Yariv Ephraim and David Malah, IEEE Transactions on Acoustics, Speech, and Signal Processing, Vol. ASSP-32, No. 6, December 1984. The method described by Ephraim and Malah was specifically developed for reducing noise in telephony speech communication. However, embodiments of the present disclosure recite the use of the SA distortion measure gain function to generate the coefficients of a noise reduction filter, and such use provides beneficial properties for ambient-aware noise reduction for hearing augmentation, as described in more detail below. This use of the SA distortion measure gain function is primarily because the SA gain function uses both the a priori and a posteriori SNRs and provides more degrees of freedom in adjusting to the noise conditions and reducing the noise.

The input audio signal 124 is a complex-valued signal that incorporates the phase of the noisy time-domain ambient audio signal 122. That is, each frequency bin component of the input audio signal 124 is a complex value because of the FFT performed by FFT block 102. The output audio signal 126 is also a complex-valued signal. However, the noise reduction filter 104 is a real-valued filter. That is, each coefficient of the noise reduction filter 104 is a real number value that the noise reduction filter 104 multiplies by the corresponding frequency bin component of the input audio signal 124 to produce the corresponding component of the estimated output audio signal 126. Thus, the noise reduction filter 104 imposes zero phase change between the input audio signal 124 and the output audio signal 126. Thus, the phase of the noisy time-domain ambient audio signal 122 that is reflected in the complex-valued input audio signal 124 is used by the noise reduction filter 104 and IFFT block 106 to reconstruct the time-domain noise-reduced ambient audio signal 128 having the same phase as the noisy time-domain ambient audio signal 122 but with spectral amplitudes modified by the coefficients of the noise reduction filter 104 that are produced by the gain function 112. As described above, the filter coefficients 132 of the noise reduction filter 104 are adapted over time by the gain estimator 108 and provided to the noise reduction filter 104. Use of the SA gain function to produce the filter coefficients 132 of the noise reduction filter 104 may also accomplish enhancement of speech present in the input audio signal 124.

In one embodiment, the modified Bessel functions of the zeroth and first order of equation (1) are approximated. In one embodiment, the approximations of the modified Bessel functions of the zeroth and first order are given respectively in equations (3) and (4) as, $$I_0(x) = \frac{\cosh(x)}{\left(1 + \frac{x^2}{4}\right)^{\frac{1}{4}}} \cdot \frac{1 + 0.24273x^2}{1 + 0.43023x^2}, \text{ and} \tag{3}$$

$$I_1(x) = \frac{x \cosh(x)}{2(1 + 0.04x^2)^{\frac{3}{4}}} \cdot \frac{1 + 0.05744x^2}{1 + 0.40244x^2}. \tag{4}$$

Figure 3:
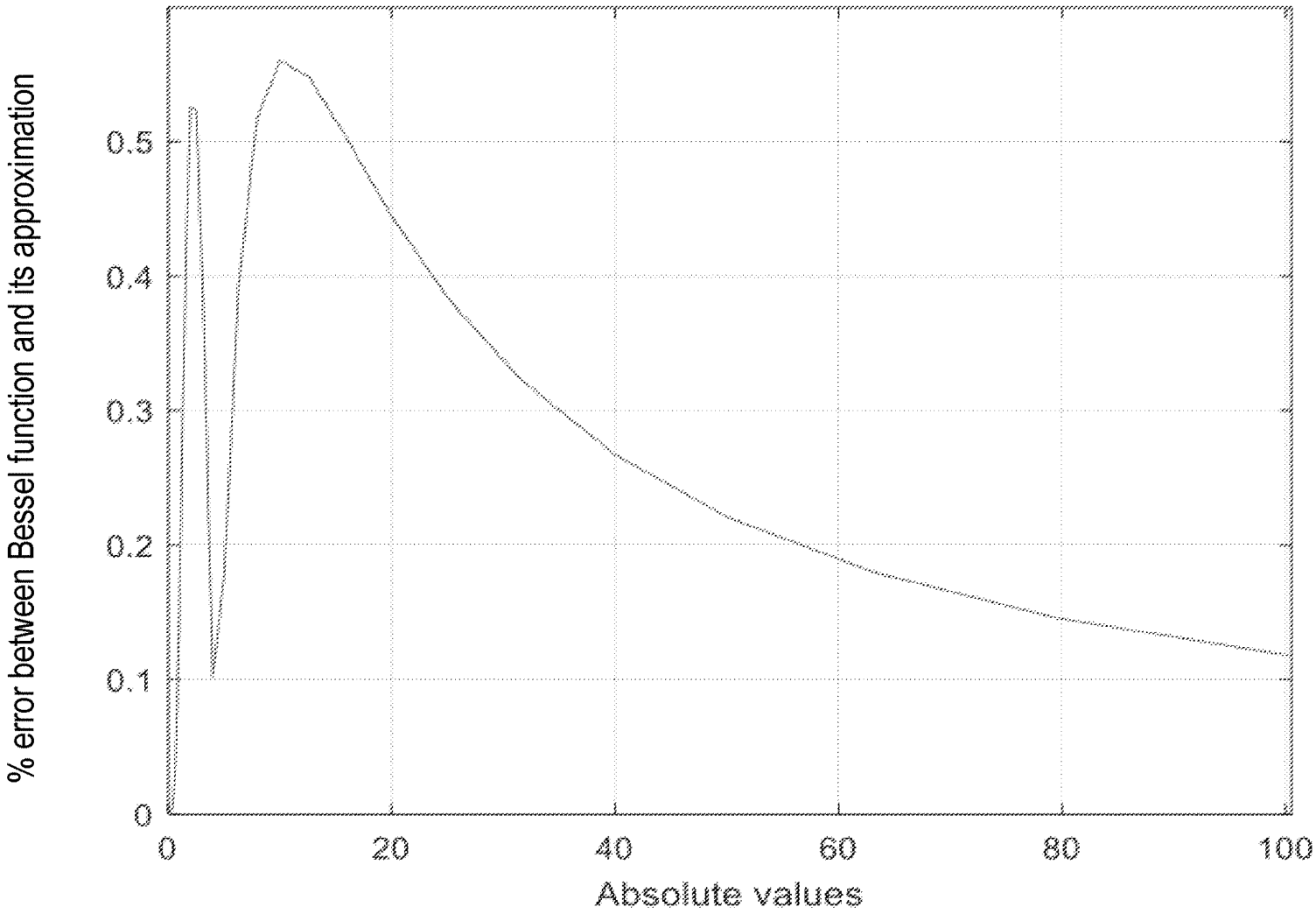
FIG. 3 is an example graph that depicts the percent error between an approximation of the modified Bessel function of the zeroth order and the true modified Bessel function of the zeroth order in accordance with embodiments of the present disclosure.
Figure 4:
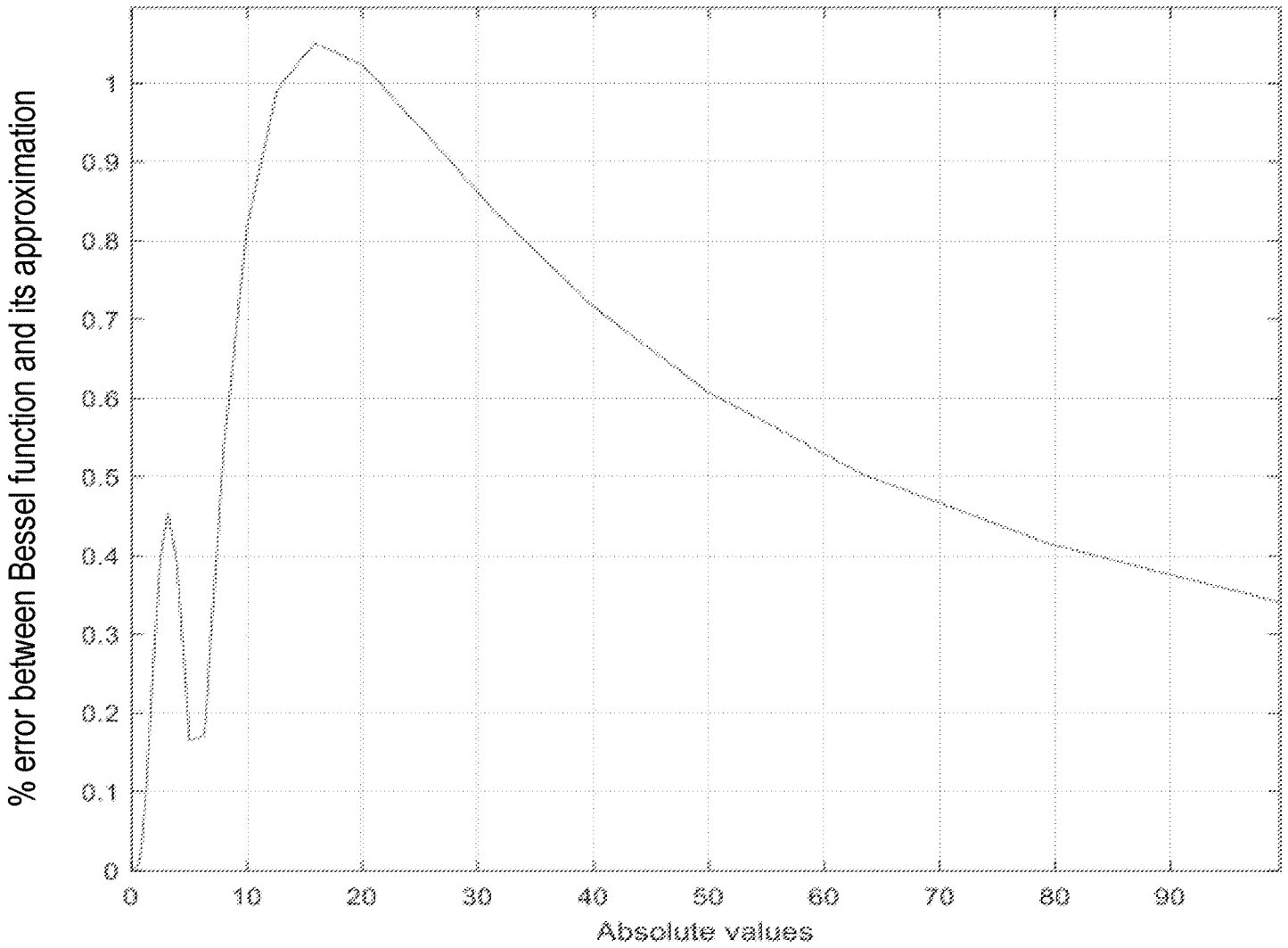
FIG. 4 is an example graph that depicts the percent error between an approximation of the modified Bessel function of the first order and the true modified Bessel function of the first order in accordance with embodiments of the present disclosure.

The graph of FIG. 3 depicts the percent error between the approximation of the modified Bessel function of the zeroth order of equation (3) and the true modified Bessel function of the zeroth order, and the graph of FIG. 4 depicts the percent error between the approximation of the modified Bessel function of the first order of equation (4) and the true modified Bessel function of the first order. As may be observed, in each case the percent error is small and may be sufficiently accurate for various uses of the noise reduction filter 104. Because the modified Bessel functions of the zeroth order and first order have no closed form expressions, it may be difficult to compute the SA gain function output values for use as coefficients of a noise reduction filter. However, the approximations of the modified Bessel functions of the zeroth order and first order provide a closed form solution that advantageously makes the SA gain function readily computable. Alternatively, a lookup table may be used to read the precomputed values of the Bessel functions, although such an embodiment may require a relatively large memory space.

Generally speaking, the a priori SNR is the SNR that is assumed to be known beforehand without the need to calculate it. For example, in an experimental setup, noise of known type and power may be added to the signal. In this case, the a priori SNR is known in advance. In practice however, the a priori SNR is not known beforehand and must be estimated from the noisy data (i.e., the noisy frequency domain signal 124) and the noise estimate $\lambda_{D_l}(k)$ 138 as shown in FIG. 1. The noise estimate 138 is derived from the noisy data 124 by a noise estimation algorithm. In one noise estimation method, silence or pauses between the noisy speech phrases or noisy audio are identified, and the noise spectrum is estimated during the pauses because during the pauses there is no speech or audio, i.e., the input audio consists of only noise. Another noise estimation method is the minimum statistics method described in Rainer Martin, "Noise Power Spectral Density Estimation Based on Optimal Smoothing and Minimum Statistics," IEEE Transactions on Speech and Audio Processing, Vol. 9, No. 5, July 2001. Yet a third noise estimation method is the Minima Controlled Recursive Averaging (MCRA) technique described in Israel Cohen, "Noise Estimation by Minima Controlled Recursive Averaging for Robust Speech Enhancement," IEEE signal processing Letters, Vol. 9, No. 1, January 2002. Generally speaking, the a posteriori SNR is the SNR calculated after receiving a new audio frame. That is, a posteriori SNR includes information revealed in the newly received audio frame. In one embodiment, the SNR estimator 114 estimates the a priori SNR 134 and the a posteriori SNR 136 according to respective equations (5) and (6) as, $$\hat{\xi}_{l|l}(k) = \frac{\hat{\xi}_{l|l-1}(k)}{1+\hat{\xi}_{l|l-1}(k)}\left(1+\frac{\hat{\xi}_{l|l-1}(k)\gamma_l(k)}{1+\hat{\xi}_{\hat{\xi}_{l|l-1}}(k)}\right) \tag{5}$$

$$\gamma_l(k) = \frac{|Y_l(k)|^2}{\lambda_{D_l}(k)}. \tag{6}$$

In one embodiment, the a priori SNR is estimated using the estimated output audio signal 126 of frames up to a frame l'. The a priori SNR $\xi_{l|l-1}(k)$ using audio frames up to frame l–1 may be computed according to equation (7) as:

$$\hat{\xi}_{l|l-1}(k) = \max\left\{\frac{\hat{A}^2_{l-1}(k)}{\lambda_{D_{l-1}}(k)}, \xi_{min}\right\}. \tag{7}$$

The quantity $\hat{A}_{l-1}(k)$ is the estimate of the spectral amplitude of noise reduced audio, and $\lambda_{D_{l-1}}(k)$ is the noise variance in frame l–1 and bin k. The a posteriori SNR $\gamma_l(k)$ may be defined according to equation (8) as:

$$\gamma_l(k) = \frac{|Y_l(k)|^2}{\lambda_{D_l}(k)}, \tag{8}$$

where, $|Y_l(k)|$ is the spectral amplitude of the noisy speech and $\lambda_{D_l}(k)$ is the noise variance at frame l and bin k. Although methods of estimating the a priori SNR and the a posteriori SNR are described with respect to equations (5) and (6), the SA gain function may be employed to generate the coefficients for the noise reduction filter 104 using other methods for estimating the a priori SNR and/or the a posteriori SNR.

When the input audio signal 124 is almost entirely stationary noise, the a priori SNR and the a posteriori SNR may be approximately equal. More specifically, the a priori SNR is generally smoother than the a posteriori SNR and has smaller variations. However, when the ambient audio signal 124 includes significant amounts of dynamic environmental sound, the a priori SNR and the a posteriori SNR may be significantly different, and the noise reduction filter 104 takes advantage of this fact to provide an enhanced ambient-aware experience for the user of the audio device, as described in more detail below. Generally speaking, dynamic environmental sound may be understood to be sound that persists less than some time, T, that it takes the estimator to detect/lock in on the stationary noise. In one embodiment, T may be employed by the noise estimator 116, and the value of T may be selected, either statically or dynamically, depending upon the type of dynamic noise the user desires to maintain.

Figure 2:
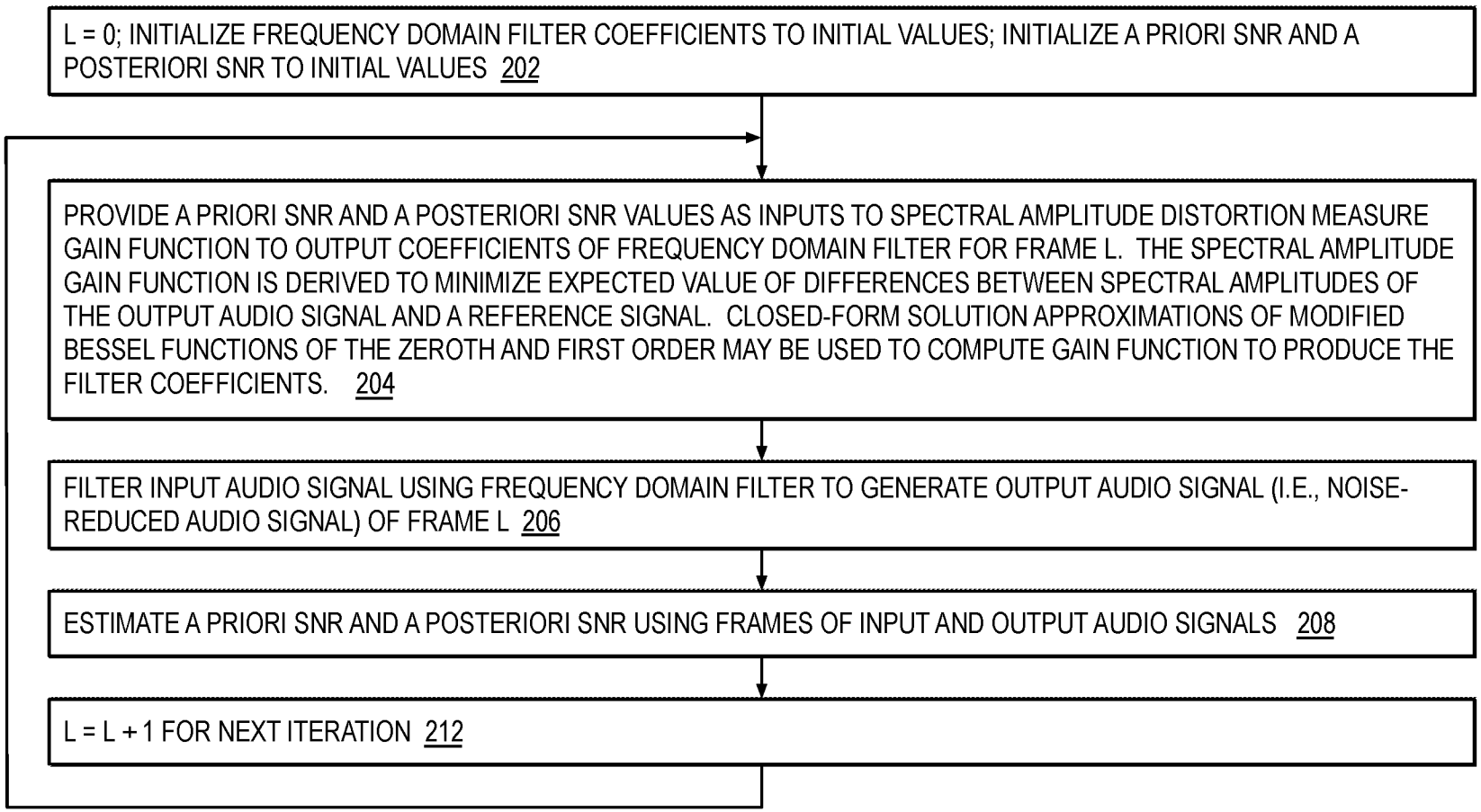
FIG. 2 is an example flowchart illustrating ambient-aware noise reduction in accordance with embodiments of the present disclosure.

FIG. 2 is an example flowchart illustrating ambient-aware noise reduction in accordance with embodiments of the present disclosure. Operation begins at block 202.

At block 202, a frame index, l, is initialized to a zero value. Additionally, frequency domain filter coefficients (e.g., filter coefficients 132 of FIG. 1) are set to initial values for each frequency bin. Still further, a posteriori SNR and a priori SNR values are set to initial values for each frequency bin. Operation proceeds to block 204.

At block 204, the a priori SNR and a posteriori SNR values (e.g., a priori SNR values 134 and a posteriori SNR values 136 of FIG. 1) are provided as inputs to a spectral amplitude distortion measure gain function (e.g., SA gain function 112 of FIG. 1 and equations (1) and (2) above). Based on the inputs, the SA gain function outputs coefficients (e.g., filter coefficients 132 of FIG. 1) for use by a frequency domain noise reduction filter (e.g., noise reduction filter 104 of FIG. 1) for frame index l. More specifically, for each frequency bin, the component of the a priori SNR associated with the frequency bin and the component of the a posteriori SNR associated with the frequency bin are provided as input to the SA gain function of equation (1), and the SA gain function outputs a gain value that is the coefficient associated with the frequency bin for the noise reduction filter 104 for frame l. As described above, the SA gain function uses a spectral amplitude distortion measure and is derived to minimize an expected value of differences between spectral amplitudes of an output audio signal (e.g., output audio signal 126 of FIG. 1) of the noise reduction filter and an input audio signal (e.g., input audio signal 124 of FIG. 1) of the noise reduction filter. Closed-form solution approximations of the modified Bessel functions of the zeroth and first order (e.g., of equations (3) and (4) above) may be used to compute the spectral amplitude gain function outputs, i.e., the filter coefficients. Operation proceeds to block 206.

At block 206, the noise reduction filter, updated with the frequency domain coefficients for frame index l generated at block 204, is used to filter an input audio signal (e.g., input audio signal 124 of FIG. 1) to generate the output audio signal of frame index l (e.g., output audio signal 126 of FIG. 1). Operation proceeds to block 208.

At block 208, the a posteriori SNR and a priori SNR are estimated (e.g., by SNR estimator 114 of FIG. 1) using the input audio signal to the noise reduction filter and the output audio signal of the noise reduction filter associated with one or more audio frames (e.g., as described above with respect to equations (5) and (6)). Operation proceeds to block 212.

At block 212, the frame index l is incremented, and operation returns to block 204 for the next iteration of the operation of blocks 204 through 208 associated with the next audio frame.

The relationship between dynamic environmental sound and a posteriori SNR is a complex non-linear relationship. However, generally speaking, as the dynamic environmental sound increases, the a posteriori SNR decreases. Additionally, as described in more detail below with respect to the graphs of FIGS. 5 through 7, as the a posteriori SNR decreases the SA gain increases (generally speaking, namely for a given a priori SNR value). As described below, the characteristics of the SA gain function enable operation of the noise reduction filter 104 according to FIG. 2 to accomplish beneficial ambient-aware noise reduction. In one embodiment, the user of the audio device may be given the opportunity to select an ambient-aware mode in which to operate the audio device, and if the user selects the ambient-aware mode, the audio device operates as described with respect to FIG. 1.

Figure 5:
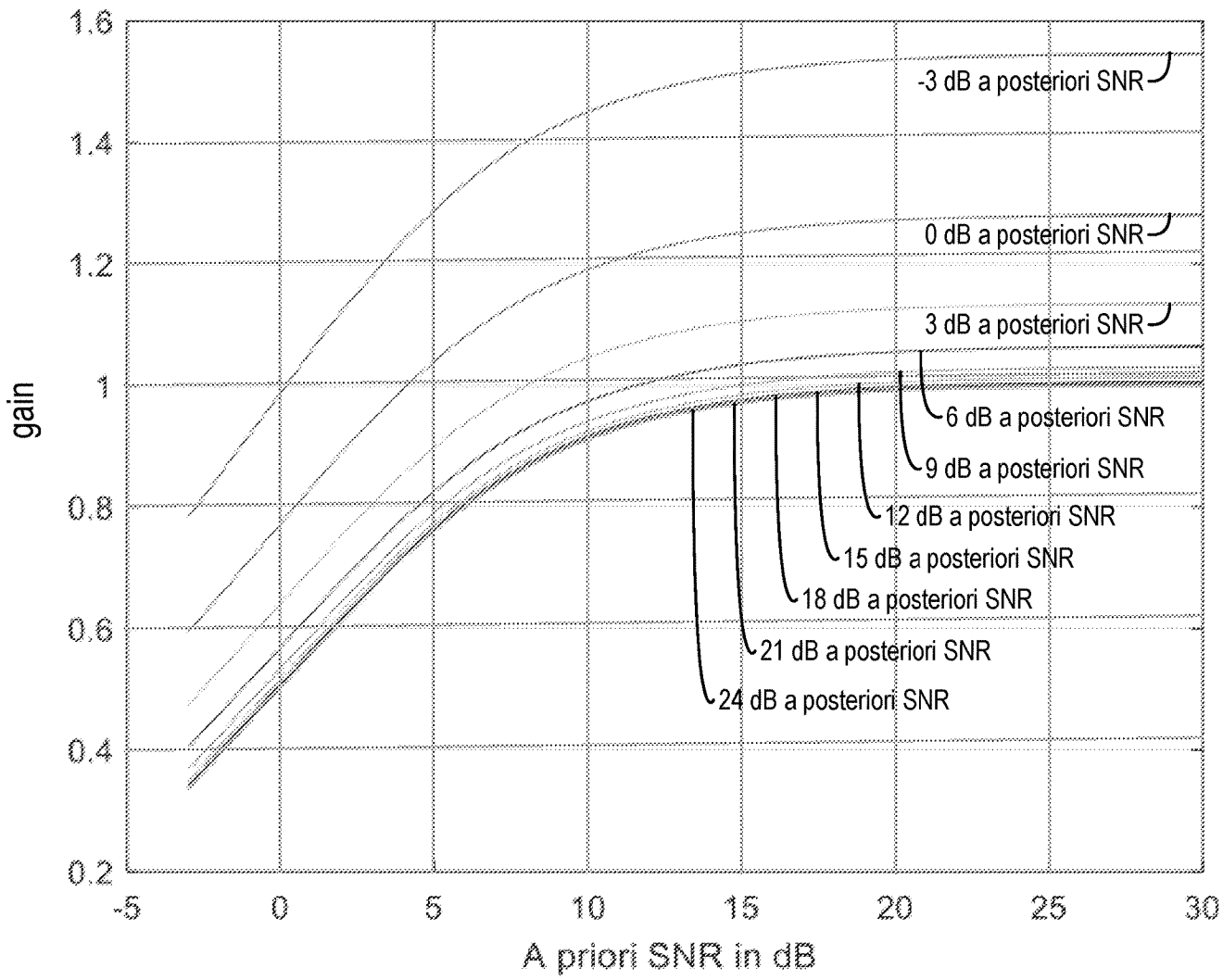
FIG. 5 is an example graph illustrating gain curves of a spectral amplitude (SA) gain function for different a priori SNR and a posteriori SNR values in accordance with embodiments of the present disclosure.

FIG. 5 is an example graph illustrating gain curves of the SA gain function of equation (1) above for different a priori SNR and a posteriori SNR values in accordance with embodiments of the present disclosure. Ten different curves are shown corresponding to ten different values of a posteriori SNR measured in decibels (dB) ranging from −3 dB to 24 dB in increments of 3 dB. The lowest curve corresponds to the largest a posteriori SNR value of 24 dB. The highest curve corresponds to the smallest a posteriori SNR value of −3 dB. The independent axis (x-axis) of FIG. 5 indicates a priori SNR measured in dB. The dependent axis (y-axis) indicates gain. That is, each point on a given curve of FIG. 5 represents the output value of the SA gain function of equation (1) for the corresponding a priori SNR and a posteriori SNR values. As explained above, an output value of the SA gain function is a frequency bin coefficient of the noise reduction filter 104 and is referred to as a gain. As may be observed, for a given a priori SNR value (e.g., 10 dB), as the a posteriori SNR decreases, the SA gain increases.

Figure 6:
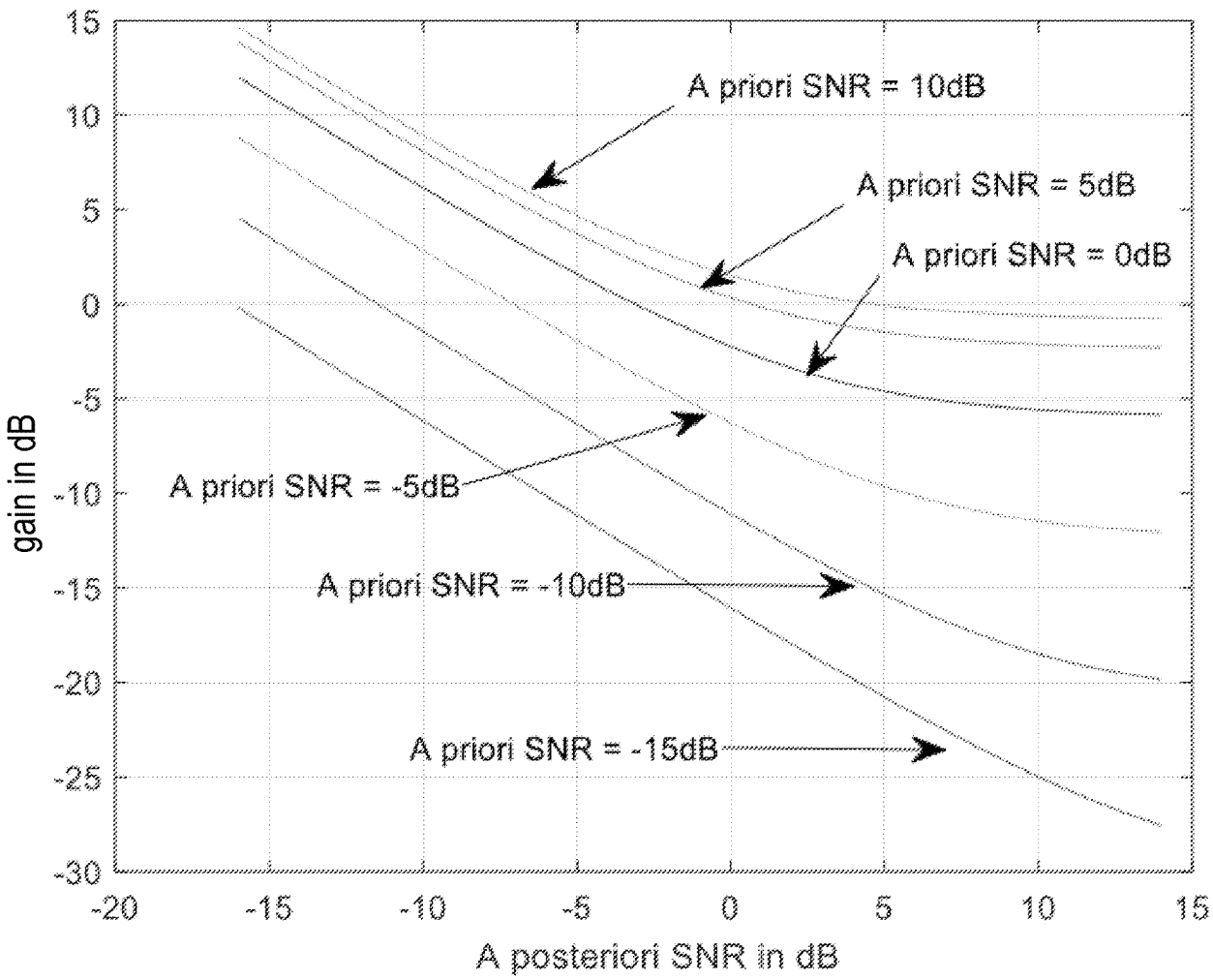
FIG. 6 is an example graph illustrating gain curves of a spectral amplitude (SA) gain function for different a priori SNR and a posteriori SNR values in accordance with embodiments of the present disclosure.

FIG. 6 is an example graph illustrating gain curves of the SA gain function of equation (1) above for different a priori SNR and a posteriori SNR values in accordance with embodiments of the present disclosure. Six different curves are shown corresponding to six different values of a priori SNR measured in dB ranging from −15 dB to 10 dB in increments of 5 dB. The bottom curve corresponds to the smallest a priori SNR value of −15 dB. The top curve corresponds to the largest a priori SNR value of 10 dB. The independent axis (x-axis) of FIG. 6 indicates a posteriori SNR measured in dB. The dependent axis (y-axis) indicates gain in dB (in contrast to the absolute gain indicated in FIG. 5). As explained above, an output value of the SA gain function is a frequency bin coefficient of the noise reduction filter 104 and is referred to as a gain. A similar observation may be made from FIG. 6 as from FIG. 5—the SA gain increases, as the a posteriori SNR decreases (for a given a priori SNR value).

Figure 7:
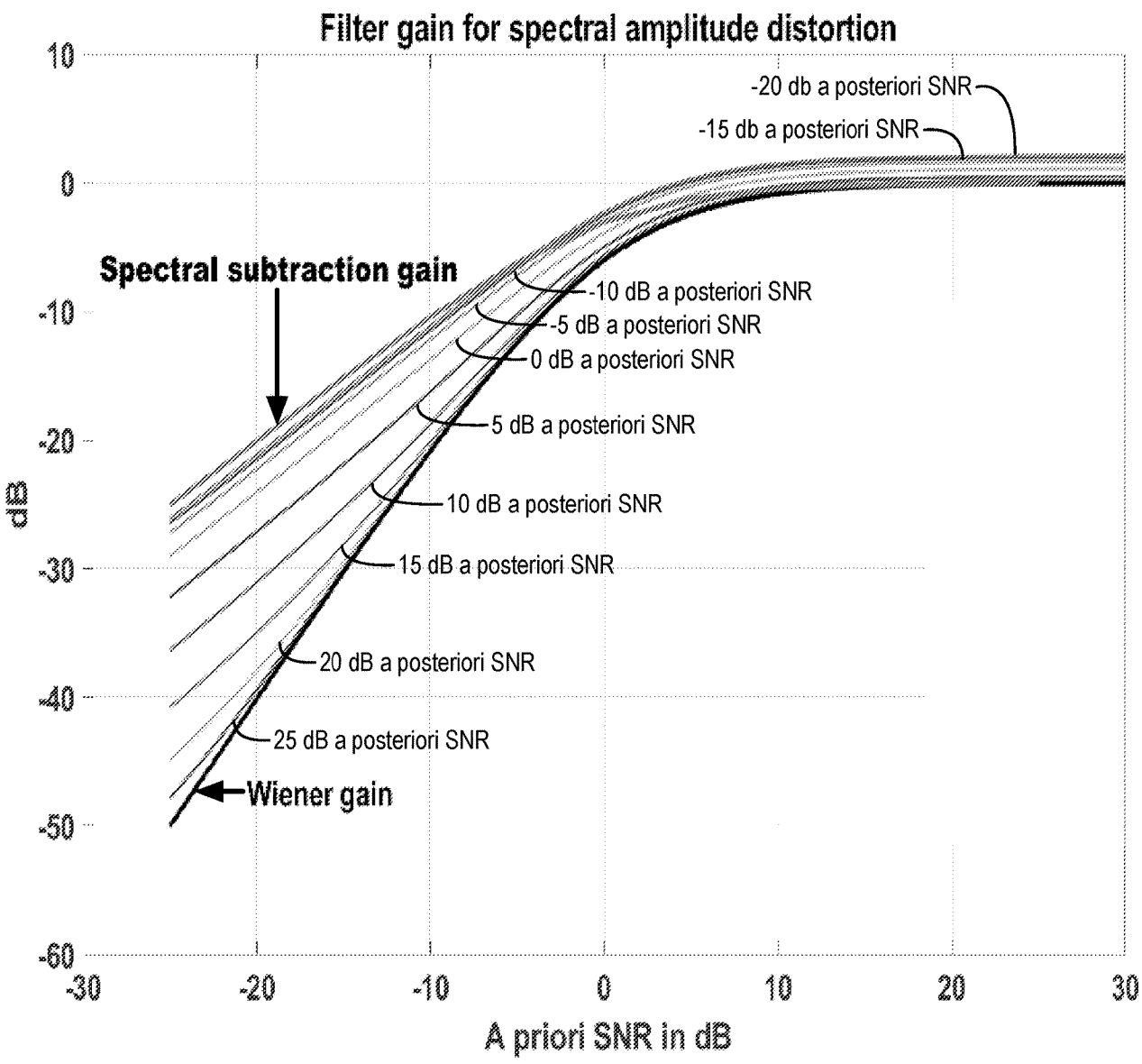
FIG. 7 is an example graph illustrating gain curves of a spectral amplitude (SA) gain function for different a priori SNR and a posteriori SNR values in accordance with embodiments of the present disclosure.

FIG. 7 is an example graph illustrating gain curves of the SA gain function of equation (1) above for different a priori SNR and a posteriori SNR values in accordance with embodiments of the present disclosure. FIG. 7 is similar in many respects to FIG. 5, except that the gain is indicated in dB, and the ten different posteriori SNR curve values range from −20 dB to 25 dB in increments of 5 dB. As shown, FIG. 7 also includes a gain curve for a Wiener gain (corresponding to the squared error distortion measure) and a gain curve for a spectral subtraction distortion measure, which are gain functions employed in conventional speech enhancement systems. In contrast to the SA distortion measure gain function which receives as input both the a priori SNR and the a posteriori SNR, the Wiener distortion measure gain function receives as input only the a priori SNR, and the spectral subtraction distortion measure gain function receives as input only the a posteriori SNR. Therefore, the Wiener gain function implies a single gain curve, and the spectral subtraction distortion measure gain function implies a single gain curve, whereas the SA gain function employed by noise reduction filter 104 implies a family of gain curves that vary based on both the a priori SNR and the a posteriori SNR. Consequently, the Wiener and spectral subtraction distortion gain functions do not vary their noise reduction as a function of both a priori SNR and a posteriori SNR as does the SA gain function, whereas the noise reduction filter 104 of FIG. 1 does vary its noise reduction as a function of both a priori SNR and a posteriori SNR.

As may be observed from FIG. 7, the SA gain approaches the Wiener gain as the a posteriori SNR increases, e.g., they are very similar at 15 dB or higher. Conversely, the SA gain approaches the spectral subtraction gain as the a posteriori SNR decreases, e.g., they are very similar at less than −20 dB. In the SA gain function, the a posteriori SNR acts as a correction parameter whose influence is essentially limited to the case where the a priori SNR is low, as may be observed from the left half of FIG. 7. When dynamic environmental sounds are present, the a priori SNR is low and therefore the effect of the a posteriori SNR is significant. As may be further observed in this region, when the a posteriori SNR is larger, the SA gain function has more attenuation, i.e., the gain decreases. The over attenuation is a consequence of the disagreement between the a priori and the a posteriori SNRs. Using these two SNRs, the noise reduction gain may be effectively adjusted depending on whether dynamic or stationary noise is dominant. If dynamic noise is dominant, the gain will be close to unity (or 0 dB). If stationary noise is dominant, noise reduction gain will be small and will attenuate the noise in frequency bins associated with the noise.

As stated above, as the dynamic environmental sound increases, the a posteriori SNR generally decreases. So, as the dynamic environmental sound increases, the SA gain generally increases (stated alternatively, the amount of noise reduction accomplished by the noise reduction filter 104 decreases) so that the user of the system 100 of FIG. 1 hears more of the dynamic environmental sound than he would in a headset that uses a Wiener gain function, for example. Conversely, as the dynamic environmental sound decreases, the SA gain decreases (stated alternatively, the amount of noise reduction accomplished by the noise reduction filter 104 increases) so that the user hears less of the stationary noise, which is also the desired effect. In this case the level of the dynamic noise increases, but the level of the stationary noise remains the same, so the ratio of dynamic to stationary noise increases, and the dynamic noise better masks the stationary noise. It has been observed that embodiments of the SA gain function noise reduction filter-based system 100 have produced a more natural sounding output audio signal with fewer artifacts/distortion than a conventional spectral subtraction gain function-based system.

In summary, the SA gain function-based noise reduction system 100 of FIG. 1 may advantageously reduce unwanted stationary noise from the ambient background while preserving dynamic environmental sound. Users have indicated in listening tests that the SA gain function-based noise reduction system provides improved ambient-aware noise reduction performance.

It should be understood—especially by those having ordinary skill in the art with the benefit of this disclosure—that the various operations described herein, particularly in connection with the figures, may be implemented by other circuitry or other hardware components. The order in which each operation of a given method is performed may be changed, unless otherwise indicated, and various elements of the systems illustrated herein may be added, reordered, combined, omitted, modified, etc. It is intended that this disclosure embrace all such modifications and changes and, accordingly, the above description should be regarded in an illustrative rather than a restrictive sense.

Similarly, although this disclosure refers to specific embodiments, certain modifications and changes can be made to those embodiments without departing from the scope and coverage of this disclosure. Moreover, any benefits, advantages, or solutions to problems that are described herein with regard to specific embodiments are not intended to be construed as a critical, required, or essential feature or element.

Further embodiments, likewise, with the benefit of this disclosure, will be apparent to those having ordinary skill in the art, and such embodiments should be deemed as being encompassed herein. All examples and conditional language recited herein are intended for pedagogical objects to aid the reader in understanding the disclosure and the concepts contributed by the inventor to furthering the art and are construed as being without limitation to such specifically recited examples and conditions.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

Finally, software can cause or configure the function, fabrication and/or description of the apparatus and methods described herein. This can be accomplished using general programming languages (e.g., C, C++), hardware description languages (HDL) including Verilog HDL, VHDL, and so on, or other available programs. Such software can be disposed in any known non-transitory computer-readable medium, such as magnetic tape, semiconductor, magnetic disk, or optical disc (e.g., CD-ROM, DVD-ROM, etc.), a network, wire line or another communications medium, having instructions stored thereon that are capable of causing or configuring the apparatus and methods described herein.

The invention claimed is:

1. An ambient-aware audio system that reduces stationary noise and maintains dynamic environmental sound in a received input audio signal, comprising:

a signal-to-noise ratio (SNR) estimator that estimates an a priori SNR and an a posteriori SNR;

a gain function that uses the estimated a priori SNR and the a posteriori SNR as inputs to compute coefficients of a frequency domain noise reduction filter; and the frequency domain noise reduction filter that uses the computed coefficients to filter a frame of the input audio signal to generate an output audio signal; and wherein the SNR estimator, gain function, and filter are configured to iterate over a plurality of frames of the input audio signal;

wherein the a posteriori SNR and the a priori SNR are estimated using the input audio signal and the output audio signal associated with one or more of the plurality of frames; and wherein the gain function is derived to minimize an expected value of differences between spectral amplitudes of the output audio signal and the input audio signal.

2. The system of claim 1, wherein the gain function that uses the a priori SNR and the a posteriori SNR to compute the frequency domain noise reduction filter coefficients comprises:

$$G\left(k, l, \xi_{l|l'(k)}, \gamma_l(k)\right) = \frac{\sqrt{\pi v_l(k)}}{2\gamma_l(k)}\left[(1+v_l(k))I_0\left(\frac{v_l(k)}{2}\right)+v_l(k)I_1\left(\frac{v_l(k)}{2}\right)\right]\exp\left(-\frac{v_l(k)}{2}\right);$$

wherein $v_l(k)$ comprises:

$$v_l(k) = \frac{\xi_{l|l'}(k)}{1+\xi_{l|l'}(k)}\gamma_l(k);$$

wherein $\xi_{l|l'}(k)$ is the estimated a priori SNR at a frame l of the plurality of frames for a frequency bin index k using the output audio signal up to a frame l' of the plurality of frames;

wherein $\gamma_l(k)$ is the estimated a posteriori SNR at frame l of the plurality of frames; and wherein $I_0$ and $I_1$ are modified Bessel functions of the zeroth order and first order, respectively.

3. The system of claim 2, wherein the modified Bessel functions of the zeroth order and first order are approximated.

4. The system of claim 3, wherein the modified Bessel functions of the zeroth order and first order are respectively approximated as:

$$I_0(x) = \frac{\cosh(x)}{\left(1+\frac{x^2}{4}\right)^{\frac{1}{4}}}\cdot\frac{1+0.24273x^2}{1+0.43023x^2}; \text{ and}$$

$$I_1(x) = \frac{x\cosh(x)}{2(1+0.04x^2)^{\frac{3}{4}}}\cdot\frac{1+0.05744x^2}{1+0.40244x^2}.$$

5. The system of claim 1, wherein the frequency domain noise reduction filter comprises a plurality of frequency bins corresponding to the coefficients; and wherein to use the estimated a priori SNR and the a posteriori SNR as inputs to compute coefficients of the frequency domain noise reduction filter, the gain function:

for each frequency bin of the plurality of frequency bins, uses a component of the a priori SNR associated with the frequency bin and a component of the a posteriori SNR associated with the frequency bin as inputs to compute the coefficient associated with the frequency bin.

6. The system of claim 1, further comprising:

a noise estimator that generates an estimate of noise in the input audio signal; and wherein the a posteriori SNR and the a priori SNR are estimated further using the noise estimate.

7. The system of claim 1, wherein the stationary noise in the received input audio signal is reduced in the output audio signal and the dynamic environmental sound in the received input audio signal is maintained in the output audio signal.

8. A method, in an ambient-aware audio system that receives an input audio signal that includes stationary noise and dynamic environmental sound, of reducing the stationary noise and maintaining the dynamic environmental sound, comprising:

(a) providing an a priori signal-to-noise ratio (SNR) and an a posteriori SNR as inputs to a gain function to output coefficients of a frequency domain noise reduction filter;

(b) filtering a frame of the input audio signal using the frequency domain noise reduction filter to generate an output audio signal; and (c) iterating steps (a) and (b) over a plurality of frames of the input audio signal;

wherein the a posteriori SNR and the a priori SNR are estimated using the input audio signal and the output audio signal associated with one or more of the plurality of frames; and wherein the gain function is derived to minimize an expected value of differences between spectral amplitudes of the output audio signal and the input audio signal.

9. The method of claim 8, wherein the gain function to which the a priori SNR and the a posteriori SNR are applied in step (a) to output the frequency domain noise reduction filter coefficients comprises:

$$G(k, l, \xi_{ll'}(k), \gamma_l(k)) = \frac{\sqrt{\pi v_l(k)}}{2\gamma_l(k)}\left[(1+v_l(k))I_0\left(\frac{v_l(k)}{2}\right)+v_l(k)I_1\left(\frac{v_l(k)}{2}\right)\right]\exp\left(-\frac{v_l(k)}{2}\right);$$

wherein $v_l(k)$ comprises:

$$v_l(k) = \frac{\xi_{ll'}(k)}{1+\xi_{ll'}(k)}\gamma_l(k);$$

wherein $\xi_{ll'}(k)$ is the estimated a priori SNR at a frame l of the plurality of frames for a frequency bin index k using the output audio signal up to a frame l' of the plurality of frames;

wherein $y_l(k)$ is the estimated a posteriori SNR at frame l of the plurality of frames; and wherein $I_0$and $I_1$ are modified Bessel functions of the zeroth order and first order, respectively.

10. The method of claim 9, wherein the modified Bessel functions of the zeroth order and first order are approximated.

11. The method of claim 10, wherein the modified Bessel functions of the zeroth order and first order are respectively:

$$I_0(x) = \frac{\cosh(x)}{\left(1+\frac{x^2}{4}\right)^{\frac{1}{4}}}\cdot\frac{1+0.24273x^2}{1+0.43023x^2};\text{ and}$$

$$I_1(x) = \frac{x\cosh(x)}{2(1+0.04x^2)^{\frac{3}{4}}}\cdot\frac{1+0.05744x^2}{1+0.40244x^2}.$$

12. The method of claim 8, wherein the frequency domain noise reduction filter comprises a plurality of frequency bins corresponding to the coefficients; and wherein said providing the a priori SNR and the a posteriori SNR as inputs to the gain function to output coefficients of the frequency domain noise reduction filter comprises:

for each frequency bin of the plurality of frequency bins, providing a component of the a priori SNR associated with the frequency bin and a component of the a posteriori SNR associated with the frequency bin as inputs to the gain function to output the coefficient associated with the frequency bin.

13. The method of claim 8, further comprising:

generating an estimate of noise in the input audio signal;

wherein the a posteriori SNR and the a priori SNR are estimated further using the noise estimate.

14. The method of claim 8, wherein the stationary noise in the received input audio signal is reduced in the output audio signal and the dynamic environmental sound in the received input audio signal is maintained in the output audio signal.

15. A non-transitory computer-readable medium having instructions stored thereon that are capable of causing or configuring an ambient-aware audio system that receives an input audio signal that includes stationary noise and dynamic environmental sound and reduces the stationary noise and maintains the dynamic environmental sound by performing operations comprising:

(a) providing an a priori signal-to-noise ratio (SNR) and an a posteriori SNR as inputs to a gain function to output coefficients of a frequency domain noise reduction filter;

(b) filtering a frame of the input audio signal using the frequency domain noise reduction filter to generate an output audio signal; and (c) iterating steps (a) and (b) over a plurality of frames of the input audio signal;

wherein the a posteriori SNR and the a priori SNR are estimated using the input audio signal and the output audio signal associated with one or more of the plurality of frames; and wherein the gain function is derived to minimize an expected value of differences between spectral amplitudes of the output audio signal and the input audio signal.

16. The non-transitory computer-readable medium of claim 15, wherein the gain function to which the a priori SNR and the a posteriori SNR are applied in step (a) to output the frequency domain noise reduction filter coefficients comprises:

$$G(k, l, \xi_{ll'}(k), \gamma_l(k)) = \frac{\sqrt{\pi v_l(k)}}{2\gamma_l(k)}\left[(1+v_l(k))I_0\left(\frac{v_l(k)}{2}\right)+v_l(k)I_1\left(\frac{v_l(k)}{2}\right)\right]\exp\left(-\frac{v_l(k)}{2}\right);$$

wherein $v_l$ comprises:

$$v_l(k) = \frac{\xi_{ll'}(k)}{1+\xi_{ll'}(k)}\gamma_l(k);$$

wherein $\xi_{ll'}(k)$ is the estimated a priori SNR at a frame l of the plurality of frames for a frequency bin index k using the output audio signal up to a frame l' of the plurality of frames;

wherein $\gamma_l(k)$ is the estimated a posteriori SNR at frame l of the plurality of frames; and wherein $I_0$ and $I_1$ are modified Bessel functions of the zeroth order and first order, respectively.

17. The non-transitory computer-readable medium of claim 16, wherein the modified Bessel functions of the zeroth order and first order are approximated.

18. The non-transitory computer-readable medium of claim 17, wherein the modified Bessel functions of the zeroth order and first order are respectively:

$$I_0(x) = \frac{\cosh(x)}{\left(1 + \frac{x^2}{4}\right)^{\frac{1}{4}}} \cdot \frac{1 + 0.24273x^2}{1 + 0.43023x^2}; \text{ and}$$

$$I_1(x) = \frac{x\cosh(x)}{2(1 + 0.04x^2)^{\frac{3}{4}}} \cdot \frac{1 + 0.05744x^2}{1 + 0.40244x^2}.$$

19. The non-transitory computer-readable medium of claim 15, wherein the frequency domain noise reduction filter comprises a plurality of frequency bins corresponding to the coefficients; and wherein said providing the a priori SNR and the a posteriori SNR as inputs to the gain function to output coefficients of the frequency domain noise reduction filter comprises:

for each frequency bin of the plurality of frequency bins, providing a component of the a priori SNR associated with the frequency bin and a component of the a posteriori SNR associated with the frequency bin as inputs to the gain function to output the coefficient associated with the frequency bin.

20. The non-transitory computer-readable medium of claim 15, further comprising:

generating an estimate of noise in the input audio signal;

wherein the a posteriori SNR and the a priori SNR are estimated further using the noise estimate.

21. The non-transitory computer-readable medium of claim 15, further comprising:

wherein the stationary noise in the received input audio signal is reduced in the output audio signal and the dynamic environmental sound in the received input audio signal is maintained in the output audio signal.

* * * * *